US006643869B1

(12) United States Patent
Sloan, Jr. et al.

(10) Patent No.: US 6,643,869 B1
(45) Date of Patent: Nov. 11, 2003

(54) PATIENT TRANSFER PLATFORM AND PATIENT TRANSFER METHOD

(76) Inventors: Eldon J. Sloan, Jr., P.O. Box 70, Broadway, NC (US) 27505; Ronald T. Sloan, P.O. Box 70, Broadway, NC (US) 27505

( * ) Notice: Subject to any disclaimer, the term of this patent is extended or adjusted under 35 U.S.C. 154(b) by 57 days.

(21) Appl. No.: 09/929,791

(22) Filed: Aug. 13, 2001

Related U.S. Application Data

(60) Provisional application No. 60/226,472, filed on Aug. 18, 2000.

(51) Int. Cl.[7] ..... A61G 7/10

(52) U.S. Cl. ..... 5/86.1; 280/304.1; 280/657; 297/5; 414/921

(58) Field of Search ..... 280/87.01, 87.1, 280/87.021, 87.041, 87.05, 304.1, 30, 657, 638, 250.1; 5/83.1, 84.1, 86.1, 87.1; 297/5; 414/921; 135/65, 66, 67, 72, 69, 70, 75

(56) References Cited

U.S. PATENT DOCUMENTS 2,757,388 A * 8/1956 Chisholm ..... 5/507.1
2,792,052 A * 5/1957 Johanessen ..... 297/5
3,272,530 A * 9/1966 Klassen ..... 280/79.2
3,405,954 A * 10/1968 Wolfe ..... 280/304.1
3,788,695 A * 1/1974 Salem ..... 297/6
4,165,127 A * 8/1979 Vago ..... 297/344.18
4,435,863 A * 3/1984 Lerich ..... 5/87.1
4,682,377 A * 7/1987 Reich ..... 5/83.1
4,918,771 A * 4/1990 James ..... 5/87.1
4,985,947 A * 1/1991 Ethridge ..... 5/86.1
5,257,425 A * 11/1993 Shinabarger ..... 5/87.1
5,347,666 A * 9/1994 Kippes ..... 5/81.1 R
D355,293 S * 2/1995 Parker ..... D34/28
5,411,044 A * 5/1995 Andolfi ..... 135/66
5,449,013 A * 9/1995 Landers ..... 135/67
5,507,044 A * 4/1996 Williamson et al. ..... 5/81.1 RP
5,509,152 A * 4/1996 Kippes ..... 5/81.1 R
D384,468 S * 9/1997 Tobias ..... D34/28
5,741,020 A * 4/1998 Harroun ..... 280/42
5,819,338 A * 10/1998 Hession ..... 5/86.1
5,839,740 A * 11/1998 Seeger ..... 280/87.021
5,892,180 A * 4/1999 Carey ..... 177/144
5,950,258 A * 9/1999 Deyne et al. ..... 5/81.1 R
6,430,761 B1 * 8/2002 Brandorff et al. ..... 5/86.1

* cited by examiner

*Primary Examiner*—Brian L. Johnson
*Assistant Examiner*—J. Allen Shriver
(74) *Attorney, Agent, or Firm*—Joseph N. Breaux

(57) ABSTRACT

A patient transfer platform that is used by the patient to lift himself/herself using his/her upper body strength to a supported position on a non-slip platform rollable on lockable wheels or casters which is then easily maneuvered about even when supporting the patient so that many partially disabled persons could remain in their homes with their families instead of being institutionalized. A method of transferring a patient that utilizes the patient transfer platform is also provided. The patient transfer platform includes a patient support deck assembly, a support frame having four frame legs secured to the patient support deck assembly and a rear trailing arm assembly secured to the patient support deck assembly.

2 Claims, 4 Drawing Sheets

PATIENT TRANSFER PLATFORM AND PATIENT TRANSFER METHOD

This application claims benefit to provisional application No. 60/226,472 Aug. 18, 2000.

TECHNICAL FIELD

The present invention relates to mobility enhancement devices and more particularly to a patient transfer platform and a patient transfer method. The patient transfer platform aspect includes a patient support deck assembly, a support frame having four frame legs secured to the patient support deck assembly and a rear trailing arm assembly secured to the patient support deck assembly; the patient support deck assembly including a substantially U-shaped frame attachment structure having four frame leg mounts provided on a upper surface thereof and each secured to one of the four support frame legs, two lockable caster assemblies provided on the underside of the two spaced apart tip ends thereof, two outrigger portions each formed in connection with an opposite end of the center section of the frame attachment structure and having a lockable caster provided on a bottom surface thereof and a docking stop provided on a trailer arm facing surface thereof, and a planar patient support platform supported by the frame attachment structure at a level below the upper surface of the frame attachment structure; the patient support platform having non-slip upper platform surface and an assistant standing area cut into the front thereof for allowing an assistant to stand near the patient while the patient is attempting to rise to a standing position on the patient support platform or lower him/herself to a sitting position from the support platform; the rear trailing arm assembly being sized to fit between the wheels of a wheel chair and under a bed and including a pair of lockable casters secured to the underside of opposed end corners thereof along an end of the rear trailing arm assembly opposite the connection location of the rear trailing arm assembly to the patient support deck assembly. In the patient transfer method aspect of the invention the method includes the steps of a) providing a patient transfer platform as previously described; b) providing a support frame having four legs sized and positioned to be securable to the four frame leg mounts; c) securing the support frame to the patient transfer platform with the four frame leg mounts; d) positioning the rear trailing arm assembly beneath a patient support structure such as a wheel chair, bed, bath seat, etc., and the locking the lockable casters; e) positioning the patient's feet on the patient support platform; f) allowing the patient to use his/her upper body strength and control to rise to a standing position supported on the patient support platform; g) unlocking the lockable casters; h) moving the patient transfer platform with the patient in a standing position while supported on the patient support platform to the desired location for transfer to another support device, such as a bed or the like, and i) positioning the rear trailing arm assembly beneath such a support device, allowing the patient to then lower him/herself from the support platform to a sitting position on such a support device, thus completing the transfer.

BACKGROUND ART

Many partially disabled individuals have sufficient upper body strength and control and can stand with support but do not have sufficient leg strength and/or control to perform the physical turning motions that are necessary to move from a bed to a wheel chair, wheel chair to a bath chair, wheel chair to an automobile seat, etc. The difficulties and risks associated with supporting and turning these individuals simultaneously while transferring them, such as from a bed to a wheel chair, a wheel chair to a bath chair, or a wheel chair to a bed, often requires the institutionalization of these individuals because nobody living with them is capable of physically assisting them with these transfers in a manner that is safe for both the patient and the care giver. It would be a benefit, therefore, to patients and families alike, to have a patient transfer platform that could be used by the patient to lift himself/herself using his/her upper body strength to a supported position on a non-slip platform on lockable wheels or casters which could then be easily maneuvered about even when supporting the patient so that many partially disabled persons could remain in their homes with their families instead of being institutionalized. It would of course also be a benefit to have a patient transfer method that utilized the patient transfer platform just described. Because patients must also be transferred while traveling, it would be a further benefit to have a patient transfer platform that could be dismantled sufficiently to fit into a vehicle and which was adapted structurally to provide maximum support for transferring a patient between a wheelchair and an automobile seat. In addition, it would also be a benefit if the patient transfer platform could be used with a conventional walker instead of support frame specifically adapted for use with the patient transfer platform to lessen the cost of the patient transfer platform and to minimize the number of items that must be carried when the patient is traveling.

GENERAL SUMMARY DISCUSSION OF INVENTION

It is thus an object of the invention to provide a patient transfer platform that includes a patient support deck assembly, a support frame having four frame legs secured to the patient support deck assembly and a rear trailing arm assembly secured to the patient support deck assembly; the patient support deck assembly including a substantially U-shaped frame attachment structure having four frame leg mounts provided on a upper surface thereof and each secured to one of the four support frame legs, two lockable caster assemblies provided on the underside of the two spaced apart tip ends thereof, two outrigger portions each formed in connection with an opposite end of the center section of the frame attachment structure and having a lockable caster provided on a bottom surface thereof and a docking stop provided on a trailer arm facing surface thereof, and a planar patient support platform supported by the frame attachment structure at a level below the upper surface of the frame attachment structure; the patient support platform having non-slip upper platform surface and an assistant standing area cut into the front thereof for allowing an assistant to stand near the patient while the patient is attempting to rise to a standing position on the patient support platform; the rear trailing arm assembly being sized to fit between the wheels of a wheel chair and under a bed and including a pair of lockable casters secured to the underside of opposed end corners thereof along an end of the rear trailing arm assembly opposite the connection location of the rear trailing arm assembly to the patient support deck assembly.

It is also an object of the invention to provide a patient transfer method that includes the steps of a) providing a patient transfer platform as previously described; b) providing a support frame having four legs sized and positioned to be securable to the four frame leg mounts; c) securing the support frame to the patient transfer platform with the four frame leg mounts; d) positioning the rear trailing arm assembly beneath a patient support structure such as a wheel chair, bed, bath seat, etc., and the locking the lockable casters; e) positioning the patient's feet on the patient support platform; f) allowing the patient to use his/her upper body strength and control to rise to a standing position supported on the patient support platform; g) unlocking the lockable casters; h) moving the patient transfer platform with the patient in a standing position while supported on the patient support platform to the desired location for transfer to another support device, such as a bed or the like, and i) positioning the rear trailing arm assembly beneath such a support device, allowing the patient to then lower him/herself from the support platform to a sitting position on such a support device, thus completing the transfer.

Accordingly, a patient transfer platform is provided. The patient transfer platform includes a patient support deck assembly, a support frame having four frame legs secured to the patient support deck assembly and a rear trailing arm assembly secured to the patient support deck assembly; the patient support deck assembly including a substantially U-shaped frame attachment structure having four frame leg mounts provided on a upper surface thereof and each secured to one of the four support frame legs, two lockable caster assemblies provided on the underside of the two spaced apart tip ends thereof, two outrigger portions each formed in connection with an opposite end of the center section of the frame attachment structure and having a lockable caster provided on a bottom surface thereof and a docking stop provided on a trailer arm facing surface thereof, and a planar patient support platform supported by the frame attachment structure at a level below the upper surface of the frame attachment structure; the patient support platform having non-slip upper platform surface and an assistant standing area cut into the front thereof for allowing an assistant to stand near the patient while the patient is attempting to rise to a standing position on the patient support platform; the rear trailing arm assembly being sized to fit between the wheels of a wheel chair and under a bed and including a pair of lockable casters secured to the underside of opposed end corners thereof along an end of the rear trailing arm assembly opposite the connection location of the rear trailing arm assembly to the patient support deck assembly.

In another embodiment the four frame leg mounts are adapted to connect with the legs of a conventional walker and the conventional walker is used as the support frame. In still another embodiment the support frame includes a low profile leading edge and a rotatable and lockable U-shaped handle bar. In yet another embodiment, the patient transfer platform further includes a safety restraint harness assembly for supporting the patient in the sanding position while being transported that includes three support frame connecting straps each connected to the support frame at one end and terminating at a free end thereof in a buckle assembly and an adjustable patient waist encircling belt having three quick fastener straps extending outwardly therefrom each terminating in a buckle insert portion adapted for connection with the buckle assembly of one of the three support frame connecting straps.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
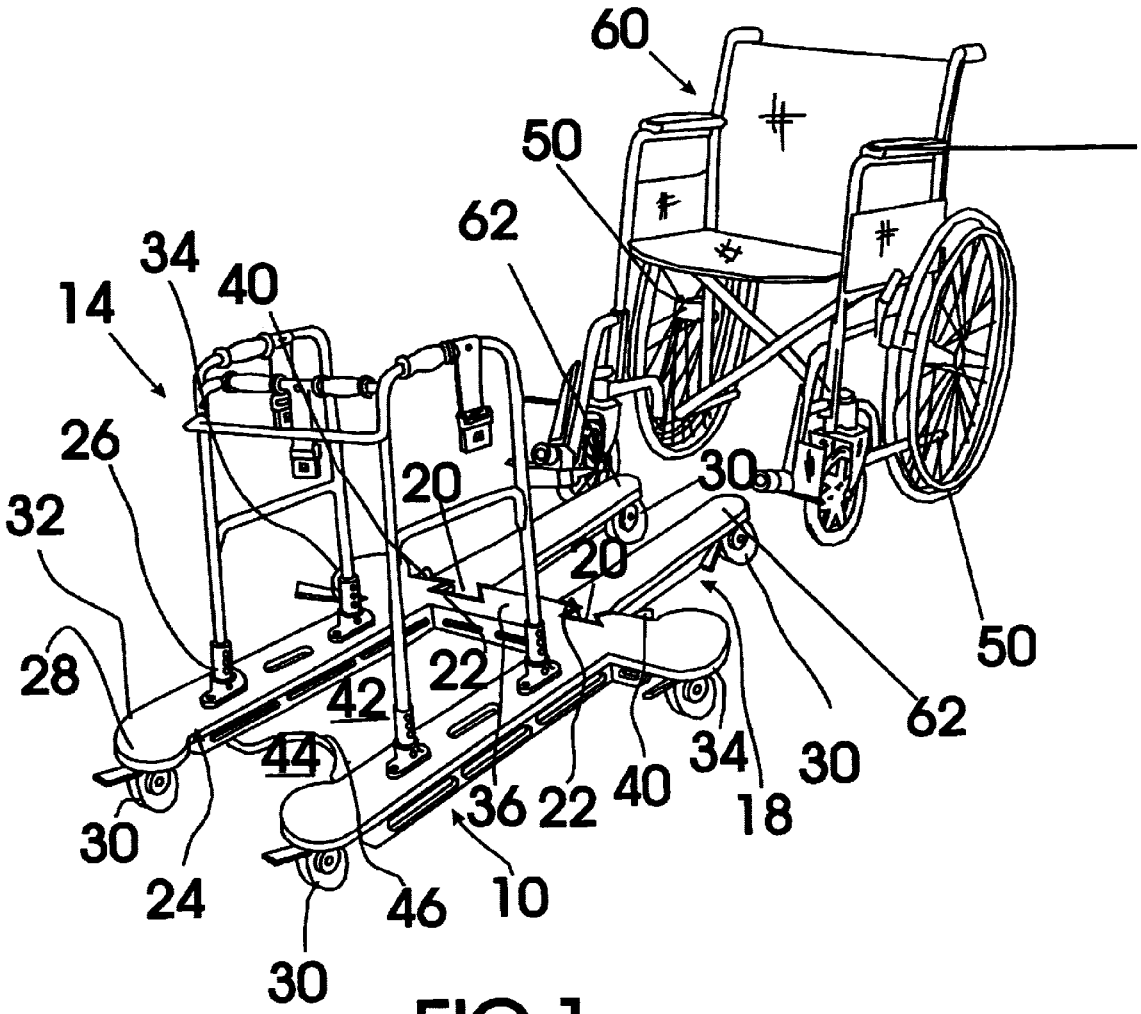
FIG. 1 is a perspective view of an exemplary embodiment of the patient transfer platform of the present invention adjacent to a wheel chair and having the four legs of the support frame of a conventional walker secured to the four walker mounts thereof.
Figure 2:
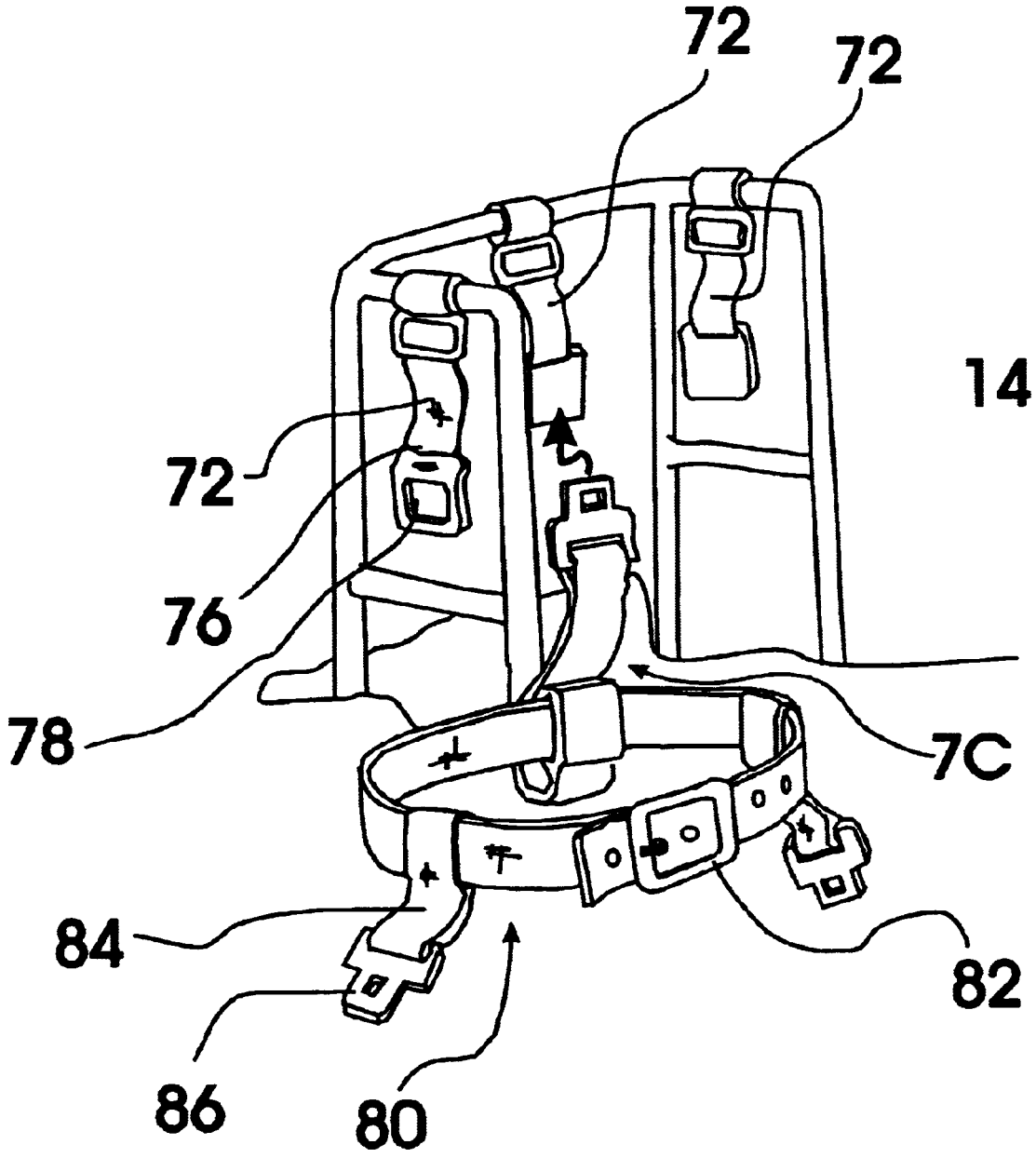
FIG. 2 is a detail perspective view of the safety restraint harness that is provided for use in the exemplary patient transfer platform shown in FIG. 1 including the three support frame connecting straps each terminating at a free end thereof in a buckle assembly and the adjustable patient waist encircling belt with the three quick fastener straps each terminating in a buckle insert portion adapted for connection with the buckle assembly of one of the support frame connecting straps.
Figure 3:
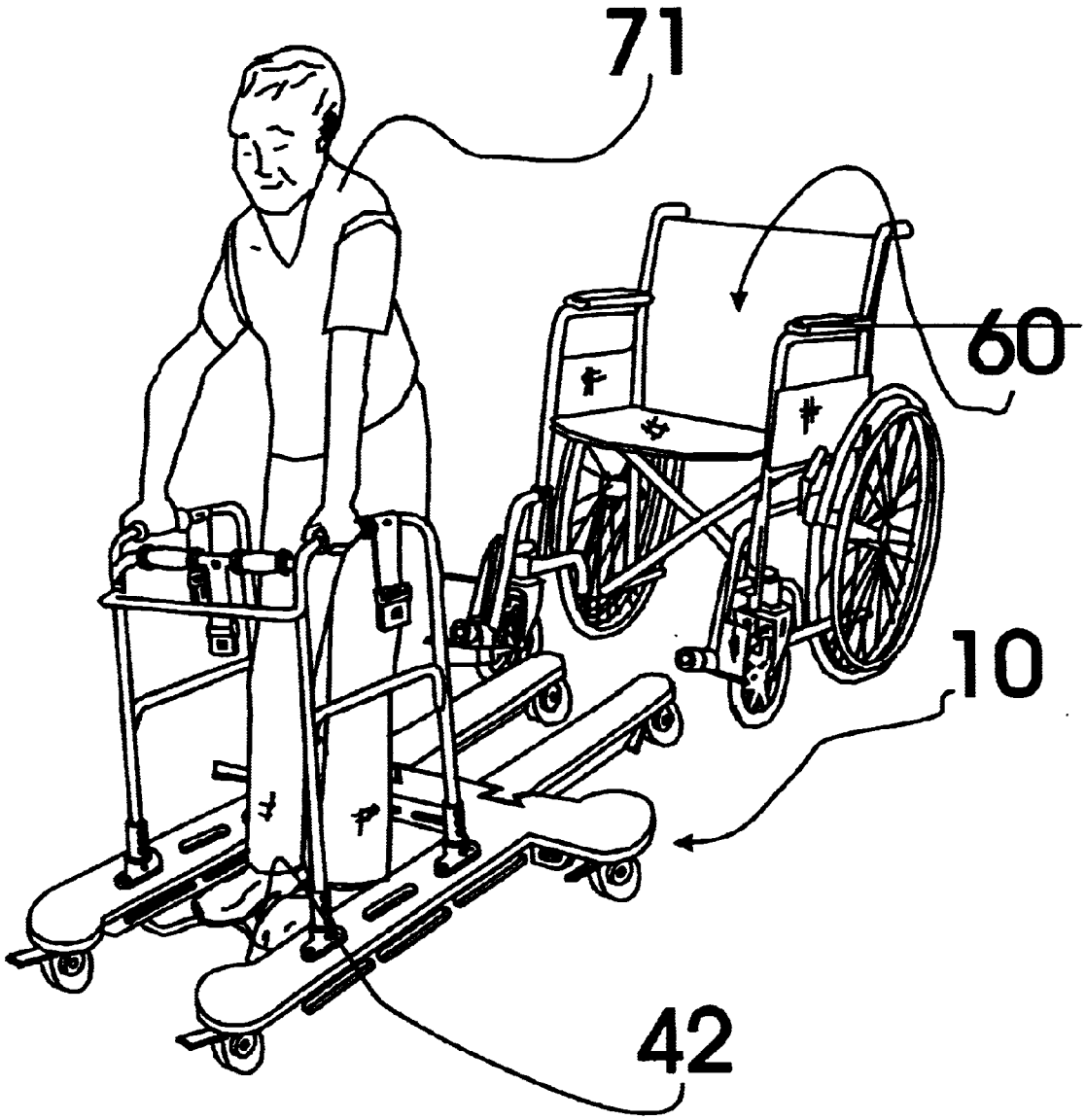
FIG. 3 is a perspective view showing the exemplary patient transfer platform of FIG. 1 being used in the exemplary patient transfer method to assist a patient in lifting herself from a seated position on the wheel chair to a standing position on the suspended non-slip floor of the patient transfer platform.

FIGS. 1–3 show various aspects of a first exemplary embodiment of the patient transfer platform of the present invention generally designated 10. Patient transfer platform 10 includes a patient support deck assembly, generally designated 12; a support frame, generally designated 14, having four frame legs 16 secured to the patient support deck assembly 12; and a rear trailing arm assembly, generally designated 18, detachably securable to patient support deck assembly 12 with two dovetail portions 20 that slide vertically into two companionate dovetail cavities 22 provided on patient support deck assembly 12. Although a dovetail attachment mechanism is used in this exemplary embodiment it should be clearly understood that any method of forming a rigid connection between the patient support deck assembly 12 and the rear trailing arm assembly 18 may be utilized without departing from the spirit and the essence of the invention taught herein.

In this embodiment patient support deck assembly 12 includes a substantially U-shaped frame attachment structure, generally designated 24, having four frame leg mounts 26 provided on a upper surface 28 thereof and each secured to one of the four support frame legs 16 of support frame 14, two lockable caster assemblies 30 provided on the underside of two spaced apart tip ends 32 thereof, two outrigger portions 34 each formed in connection with an opposite end of a center section 36 of frame attachment structure 24 and having a lockable caster 30 provided on a bottom surface thereof and a docking stop 40 provided on a trailer arm facing surface thereof, and a planar patient support platform 42 supported by frame attachment structure 24 at a level below the upper surface 28 of frame attachment structure 24. Patient support platform 42 is rigid, has non-slip upper platform surface and an assistant standing area 44 cut into the front 46 thereof for allowing an assistant to stand near the patient while the patient is attempting to rise to a standing position on patient support platform 42 as shown in FIG. 3.

Rear trailing arm assembly 18 is sized to fit between the wheels 50 and beneath the seat 52 of a wheel chair, generally designated 60 and under a bed or other support structure commonly used such as shower chairs and the like. Rear trailing arm assembly 18 includes a pair of lockable casters 30 secured to the underside of opposed end corners 62 thereof along an end of the rear trailing arm assembly 18 opposite the connecting mechanism for detachably securing rear trailing arm assembly 18 to patient support deck assembly 12.

In the embodiment shown in FIGS. 1–3 support frame 14 is a conventional walker to lessen the cost to the patients family by allowing the walker to do double duty as well as to allow the patient and family to have to carry one less item when traveling. Patient transfer platform 10 also includes an optional safety restraint harness assembly, generally designated 70 for supporting the patient 71 in the sanding position while being transported. Safety restraint harness assembly 70 includes three support frame connecting straps, generally designated 72, each connected to support frame 14 at one end and terminating at a free end 76 thereof in a buckle assembly 78 and an adjustable patient waist encircling belt, generally designated 80 having an adjustment buckle 82 and three quick fastener straps 84 extending outwardly therefrom each terminating in a buckle insert portion 86 adapted for connection with the buckle assembly 78 of one of the three support frame connecting straps 71.

Figure 4:
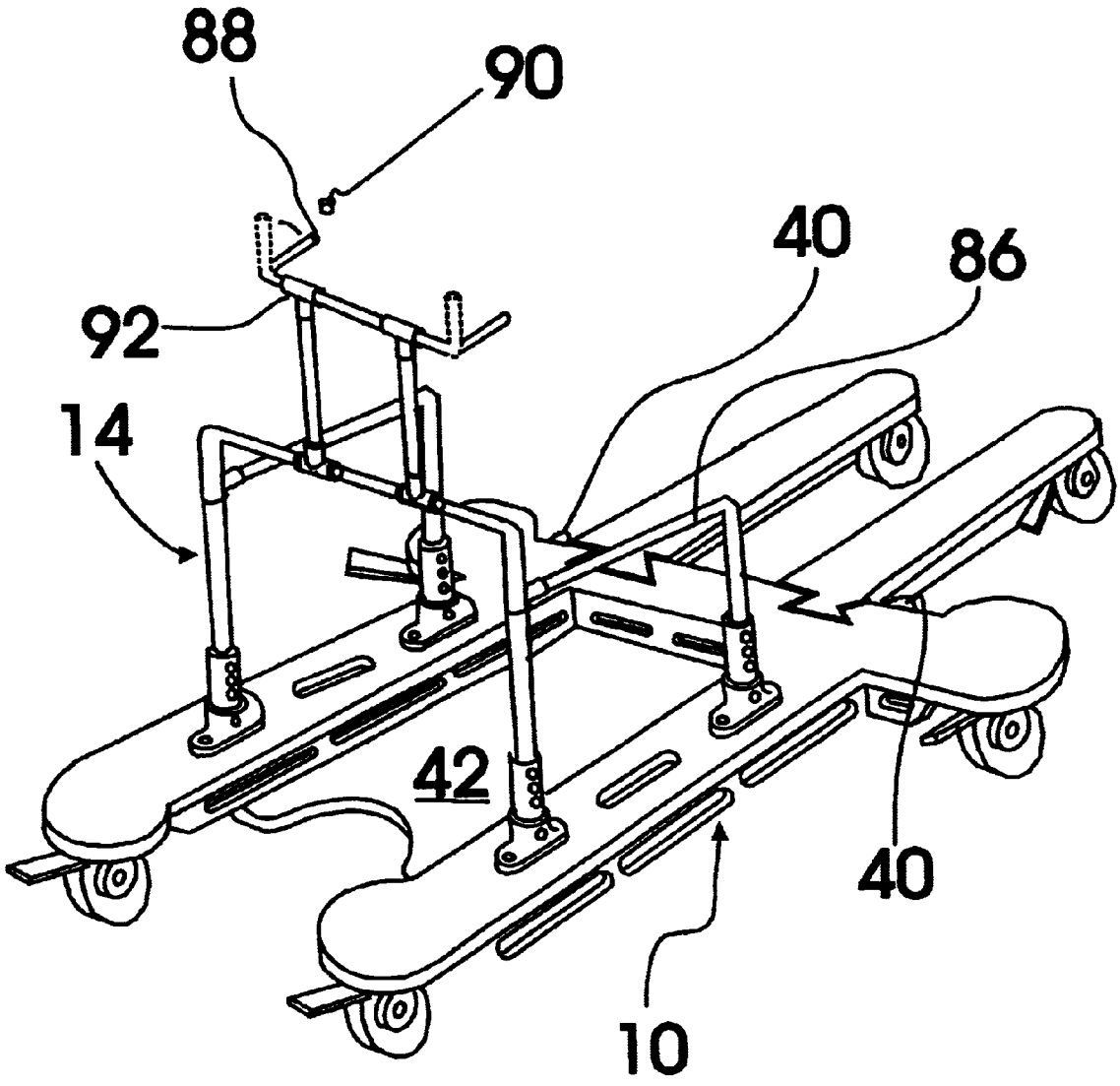
FIG. 4 is a perspective view of the exemplary patient transfer platform of FIG. 1 with a special frame assembly adapted specifically for use with the patient transfer platform attached to the four walker mounts; the special frame assembly including a rotatable and lockable handle bar assembly supported by a low profile frame; the handle bar is rotatable between a horizontal position and a vertical position. This frame is designed to allow greater access to a patient during an automobile transfer.

FIG. 4 shows a second exemplary patient transfer platform, generally designated 10*a*, that is identical in all respects to patient transfer platform 10 of FIGS. 1–3 except patient transfer platform 10 includes a support frame 14*a* that includes a low profile leading edge 86 to allow for closer positioning against a patient support structure, such a vehicle, and a rotatable and lockable U-shaped handle bar 88. Handle bar 88 may be positioned and locked or otherwise prevented from rotating out of the upright position while the patient is pulling him/herself up to a standing position and then rotated to the horizontal position and locked or otherwise restricted from rotating to provide vertical support to the patient while the patient is standing on patient support platform 42. In this embodiment handle bar 88 is lockable using a locking pin 90 that is insertable through bracket hole 92 into a vertical locking hole formed through handle bar 88 and lockable in a horizontal position by inserting locking pin 90 through bracket hole 92 and into a horizontal locking hole formed through handle bar 88 at a ninety degree angle with respect to the vertical locking hole. Although a locking pin and locking hole locking mechanism is used in this embodiment, it should be understood that any locking mechanism can be used without departing from the spirit and the essence of the invention taught herein.

An exemplary patient transfer method is now described with general reference to FIGS. 1–4. The exemplary patient transfer method includes the steps of a) providing a patient transfer platform 10 as previously described; b) providing a support frame 14 having four legs 16 sized and positioned to be securable to the four frame leg mounts 26; c) securing support frame 14 to the patient transfer platform 10 with the four frame leg mounts 26; d) positioning the rear trailing arm assembly 18 beneath a patient support structure such as a wheel chair 60 and the locking the lockable casters 30; e) positioning the patient's feet onto the patient support platform 42; f) allowing the patient 71 to use his/her upper body strength and control to rise to a standing position supported on the patient support platform 42 by grasping onto support frame 14; g) unlocking the lockable casters 30; h) moving the patient transfer platform 10 with the patient 71 in a standing position while supported on the patient support platform 10 to the desired location for transfer to an other support device; and i) positioning the rear trailing arm assembly beneath the other support device, allowing the patient to then lower him/herself from the support platform to a sitting position on the other support device, thus completing the transfer.

It can be seen from the preceding description that a patient transfer platform and a patient transfer method have been provided.

It is noted that the embodiments of the patient transfer platform and patient transfer method described herein in detail for exemplary purposes are of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A patient transfer platform comprising:

a patient support deck assembly;

a support frame having four support frame legs secured to the patient support deck assembly; and a rear trailing arm assembly secured to the patient support deck assembly;

the patient support deck assembly including a substantially U-shaped frame attachment structure having four frame leg mounts provided on a upper surface thereof and each secured to one of the four support frame legs, two lockable caster assemblies provided on the underside of two spaced apart tip ends thereof, two outrigger portions each formed in connection with an opposite end of a center section of the frame attachment structure and having a lockable caster provided on a bottom surface thereof and a docking stop provided on a trailer arm facing surface thereof, and a planar patient support platform supported by the frame attachment structure at a level below the upper surface of the frame attachment structure;

the patient support platform having non-slip upper platform surface and an assistant standing area cut into the front thereof for allowing an assistant to stand near the patient while the patient is attempting to rise to a standing position on the patient support platform;

the rear trailing arm assembly including a pair of lockable casters secured to the underside of opposed end corners thereof along an end of the rear trailing arm assembly opposite a connection location of the rear trailing arm assembly to the patient support deck assembly.

2. A patient transfer method that includes the steps of a) providing a patient transfer platform comprising: a patient support deck assembly; a support frame having four support frame legs secured to the patient support deck assembly; and a rear trailing arm assembly secured to the patient support deck assembly; the patient support deck assembly including a substantially U-shaped frame attachment structure having four frame leg mounts provided on a upper surface thereof and each secured to one of the four support frame legs, two lockable caster assemblies provided on the underside of two spaced apart tip ends thereof, two outrigger portions each formed in connection with an opposite end of a center section of the frame attachment structure and having a lockable caster provided on a bottom surface thereof and a docking stop provided on a trailer arm facing surface thereof, and a planar patient support platform supported by the frame attachment structure at a level below the upper surface of the frame attachment structure; the patient support platform having non-slip upper platform surface and an assistant standing area cut into the front thereof for allowing an assistant to stand near the patient while the patient is attempting to rise to a standing position on the patient support platform; the rear trailing arm assembly including a pair of lockable casters secured to the underside of opposed end corners thereof along an end of the rear trailing arm assembly opposite a connection location of the rear trailing arm assembly to the patient support deck assembly; b) providing a support frame having four legs sized and positioned to be securable to the four frame leg mounts; c) securing the support frame to the patient transfer platform with the four frame leg mounts; d) positioning the rear trailing arm assembly beneath a patient support structure and then locking the lockable casters; e) positioning the patient's feet on the patient support platform; f) allowing the patient to use his/her upper body strength and control to rise to a standing position supported on the patient support platform; g) unlocking the lockable casters; h) moving the patient transfer platform with the patient in a standing position while supported on the patient support platform to the desired location for transfer to an other support device; and i) positioning the rear trailing arm assembly beneath the other support device, allowing the patient to then lower him/herself from the support platform to a sitting position on the other support device, thus completing the transfer.

* * * * *